US005558330A

United States Patent [19]

McCune

[11] Patent Number: 5,558,330

[45] Date of Patent: Sep. 24, 1996

[54] PLAYING CARD ORGANIZER

[76] Inventor: Eve N. McCune, 1219 Inca La., Henderson, Nev. 89015

[21] Appl. No.: 503,552

[22] Filed: Jul. 18, 1995

[51] Int. Cl.[6] ..... A63F 1/10

[52] U.S. Cl. ..... 273/150; 273/148 A

[58] Field of Search ..... 273/150, 148 A, 273/286

[56] References Cited

U.S. PATENT DOCUMENTS

| | | | |
|---|---|---|---|
| 1,269,276 | 6/1918 | Harris | 273/286 |
| 4,266,771 | 6/1979 | Carbone | 273/150 |
| 4,684,132 | 8/1987 | Wolford | 273/150 |
| 5,082,116 | 1/1992 | Schanne | 273/148 A |

FOREIGN PATENT DOCUMENTS

| | | | |
|---|---|---|---|
| 215627 | 5/1924 | United Kingdom | 273/148 A |
| 404313 | 1/1934 | United Kingdom | 273/148 A |
| 2122098 | 1/1984 | United Kingdom | 273/148 A |

*Primary Examiner*—Benjamin H. Layno
*Attorney, Agent, or Firm*—Joseph N. Breaux

[57] ABSTRACT

The playing card organizer comprises: a planar mat having a playing surface and a back surface, a plurality of strap members aligned parallel to one another and connected to the playing surface, and a plurality of card slots defined by the strap members and the playing surface adapted for holding playing cards in a fixed position. The playing card organizer allows a player to collect books of cards of the same rank together and facilitates the playing of card games in windy locations or on unstable surfaces.

1 Claim, 1 Drawing Sheet

PLAYING CARD ORGANIZER

DESCRIPTION

1. Technical Field

The present invention relates to devices for organizing playing cards and more particularly to devices for organizing playing cards that allows the user to collect playing cards into books.

2. Background Art

In many card games such as rummy type games and in canasta it is necessary for the players to collect cards of the same rank into books or into runs of consecutive cards. In these games it is often difficult to hold all of the cards collected and still easily recognize how many or what cards are needed to be collected. At times it is also required to lay the cards onto the playing surface for all of the players to view the cards. This requirement often makes it difficult to play the game outdoors where the wind may blow the cards away. Having to lay the cards out also requires that the game be played on a level surface which has a large surface area. In addition, when it is required to delay a game it is often impossible to leave the cards where they are during the interim. Unfortunately, there are no card holders known to be available which address all of these criteria.

It would be a benefit, therefore, to have a playing card organizer which can maintain a hand of cards in a manner which allows for easy recognition of the cards needed to be collected. It would be a further benefit to have a playing card organizer which maintains the cards in a fixed position in windy locations or on unlevel or unstable surfaces. It would be an additional benefit to have a playing card organizer which may be moved without disturbing the arrangement of the playing cards. It would also be a benefit to have a playing card organizer which allows for playing cards on a relatively small surface area.

GENERAL SUMMARY DISCUSSION OF INVENTION

It is thus an object of the invention to provide a playing card organizer that maintains a hand of cards in a manner which allows for easy recognition of the cards needed to be collected.

It is a further object of the invention to provide a playing card organizer that maintains the cards in a fixed position in windy locations or on unlevel or unstable surfaces.

It is a still further object of the invention to provide a playing card organizer that may be moved without disturbing the arrangement of the playing cards.

It is a still further object of the invention to provide a playing card organizer that allows for playing cards on a relatively small surface area.

Accordingly, a playing card organizer of the type having card slots for maintaining playing cards in a fixed position and in order is provided. The playing card organizer comprises: a planar mat having a playing surface and a back surface, a plurality of strap members aligned parallel to one another and connected to the playing surface, and a plurality of card slots defined by the strap members and the playing surface adapted for holding playing cards in a fixed position.

The planar mat may be rigid and formed of cardboard or any other material suitable for a gameboard. Preferably, a rigid planar mat is constructed to be foldable. The planar mat may be constructed of a flexible material such as cloth, vinyl or rubber so that it can be rolled up or folded when not in use. A sheet of material which is impermeable to water, such as rubber, may be disposed on the back surface of the planar mat.

The planar mat may be constructed in any shape which allows the user to organize playing cards in the manner needed for the game being played. Preferably, the planar mat is rectangular.

The strap members may be flexible and formed of material such as cloth or elastic. The strap members may be rigid and formed of a plastic. Preferably, the strap members are formed of utility ribbon. More preferably, the strap members are ribbed to frictionally grip the playing cards. The strap members may be the same color. The strap members may be of different color or of alternating colors.

The strap members are aligned parallel with one another and are connected to the playing surface. The strap members may be disposed along the vertical axis of the planar mat. Preferably, the strap members are disposed along the horizontal axis of the planar mat.

The strap members may be connected to the playing surface by glueing, stitching or any other means suitable for the materials used for the planar mat and the strap members. The strap members are connected to the playing surface at the ends and at intervals along the length of the strap member so that card slots are defined between the playing surface and the strap member. The card slots may be sized to fit various size playing cards. Preferably, the card slots are aligned in columns of six suitable for organizing cards into books as in various rummy type card games. More preferably, the card slots are arranged into twelve columns of six card slots each and the rank of a playing card from three through the ace is embossed above each column.

In use of a preferred embodiment of the playing card organizer the player engaged in a game of canasta. As playing cards of a rank are collected they are placed in the column designated for that rank. Upon collection of the seventh card of the same rank all the cards may be removed from that rank column forming a book.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
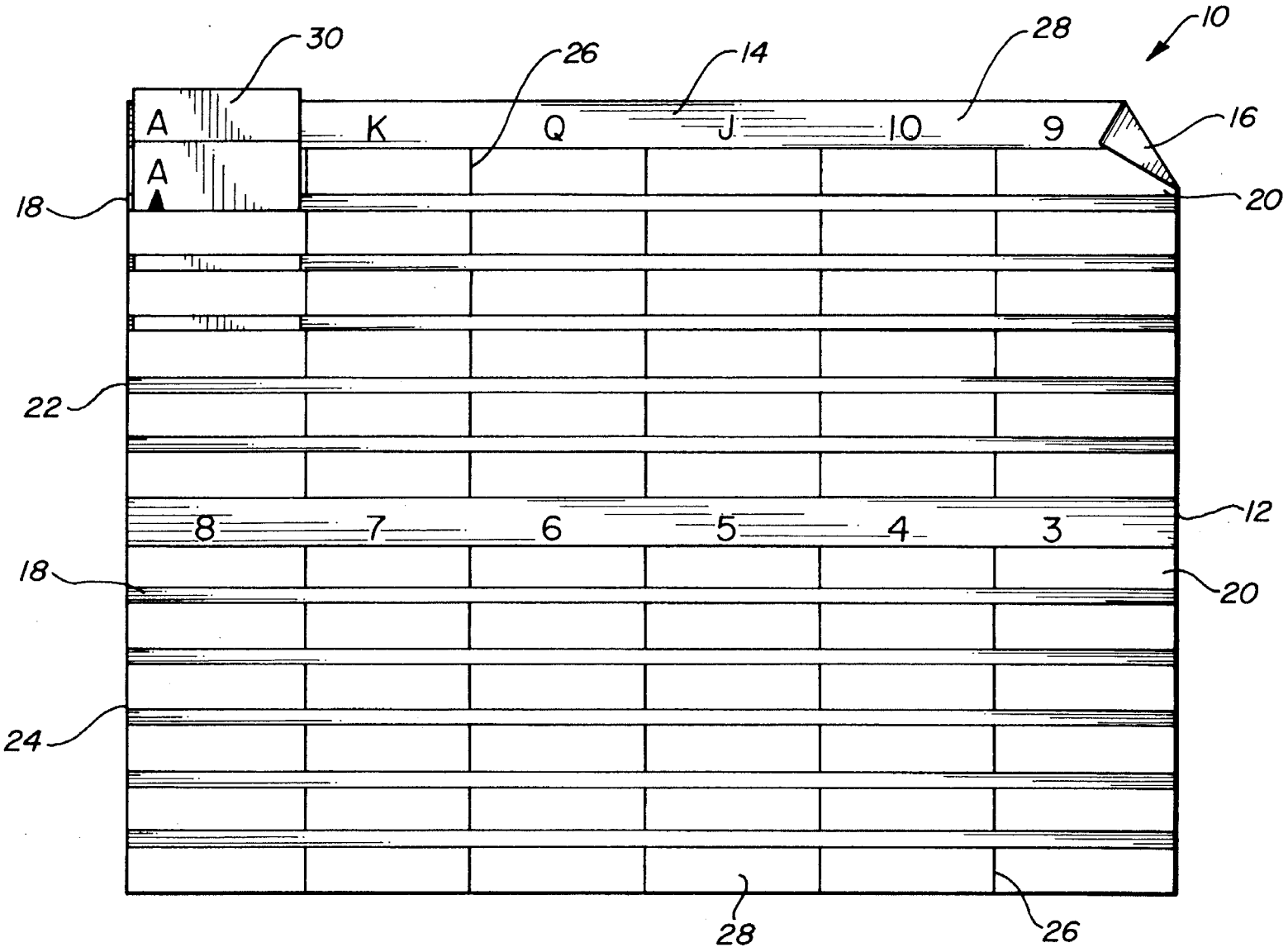
FIG. 1 is a plan view of an exemplary embodiment of the playing card organizer.

FIG. 1 is a plan view of an exemplary embodiment of the playing card organizer of the present invention generally designated by the numeral 10. Playing card organizer 10 includes a planar mat 12 having a playing surface 14 and a back surface 16, card slots 18 and twelve strap members 20.

Planar mat 12 is formed of vinyl and is seventeen inches along its horizontal axis and thirteen inches along its vertical axis. Planar mat 12 is divided along its horizontal axis into a top section and bottom section 22,24.

Strap members 20 are ribbed cloth utility ribbons one inch in width and are of various colors. Six strap members 20 are evenly spaced and aligned horizontally across top section 22 leaving a portion of playing surface 14 visible along the upper portion of top section 22. The top strap member 20 is green in color. The bottom strap member 20 and the next to bottom strap member 20 are red and yellow in color respectively.

Strap members 20 are connected to planar mat 12 by stitching evenly spaced vertical seams 26 forming six columns 28 of card slots 18. Card slots 18 are defined by strap members 20 and playing surface 14 and are sized to fit conventional playing cards 30. A card rank from ace to nine is embossed on planar mat 12 above each column of card slots.

Six columns 28 of card slots 18 are formed along bottom section 24 of playing surface 14 in the same manner as along top section 22. A card rank from eight to three is embossed on planar mat 12 above each column of card slots.

It can be seen from the preceding description that a device for organizing playing cards which maintains a hand of cards in a manner which allows for easy recognition of the cards still needed to be collected, that maintains the cards in a fixed position in windy locations or on unlevel or unstable surfaces, that may be moved without disturbing the arrangement of the playing cards, and that allows for playing card on a relatively small surface area has been provided.

It is noted that the embodiment of the playing card organizer described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A playing card organizer comprising:

a flexible mat having twelve flexible strap member affixed to a front playing surface of said flexible mat in a manner to define twelve columns, each of said twelve columns including six card slots, each of said twelve strap members being of a different color than any one of said twelve strap members adjacent thereto;

adapted for holding playing cards and a water impermeable sheet disposed on a back surface thereof, a first six column set of said twelve columns being positioned on a top section of said playing surface in a manner to leave a portion of said playing surface along an upper portion of said top section visible, a second six column set of said twelve columns being positioned on a bottom section of said playing surface in a manner to leave a portion of said playing surface between said first six column set and said second six column set visible, each column of said first six column set having a rank of a playing card embossed thereabove on said portion of said playing surface along an upper portion of said top section, each column of said second six column set having a rank of a playing card embossed thereabove on said portion of said playing surface between said first six column set and said second six column set.

* * * * *